United States Patent [19]

Reiss et al.

[11] 4,032,028

[45] June 28, 1977

[54] SAFETY CAP

[75] Inventors: Oscar Reiss, Great Neck; Leon R. Brynes, Brooklyn; Frank De Cicco, Hamilton Beach, all of N.Y.

[73] Assignee: APL Corporation, New York, N.Y.

[22] Filed: Sept. 13, 1976

[21] Appl. No.: 722,949

[52] U.S. Cl. ..... 215/217; 215/223

[51] Int. Cl.[2] ..... B65D 85/56; B65D 55/02; A61J 1/00

[58] Field of Search ..... 215/217, 222, 223

[56] References Cited

UNITED STATES PATENTS

| | | | |
|---|---|---|---|
| 2,776,066 | 1/1957 | Thornton | 215/217 |
| 3,952,899 | 4/1976 | Cooke | 215/217 |
| 3,979,001 | 9/1976 | Bogert | 215/217 |

*Primary Examiner*—George T. Hall
*Attorney, Agent, or Firm*—Caesar, Rivise, Bernstein & Cohen, Ltd.

[57] ABSTRACT

A screw-type safety cap for use in combination with a bottle is disclosed wherein the bottle is of the type having a threaded neck with a top planar edge. The cap includes a top wall and a depending peripheral skirt. The skirt has a thread on the inner surface thereof for rotatably engaging and securing the cap with the threaded neck of the bottle. The cap has a resilient member disposed under the top of the cap for engaging the top edge of the neck. The threads of the cap and the threads of the bottle are so dimensioned in thickness and space therebetween that the cap is axially slidable with respect to the bottle. The threads on the bottle have at least two interruptions which form at least two recesses in the threads of the bottle. The cap has at least two projections on the inner surface of the skirt. The projections are spaced both axially and radially with respect to each other as are the two recesses in the bottle thread. The projection on the skirt which is most spaced from the top of the cap is dimensioned so that it is too large to fit in any recess of the botttle other than the recess lowest on the neck of the bottle. The cap is secured to the bottle by rotating the cap until all of the projections are aligned with the recesses. The resilient member causes the cap to be urged away from the bottle and the projections to be disposed in the recesses whereby the cap is locked on the bottle and cannot be removed unless the user presses the cap against the bottle to dislodge the projections from the recesses to enable unscrewing of the cap.

4 Claims, 5 Drawing Figures

SAFETY CAP

This invention relates generally to safety caps for bottles and more particularly to a safety cap of the screw-type for use with plastic bottles.

The instant invention is an improvement over the safety cap shown in co-pending U.S. Application Ser. No. 516,231 filed on Oct. 18, 1974 now Pat. No. 3,979,001. The aforesaid application shows a cap of the screw-type which is used in combination with a bottle having a threaded neck. The safety cap shown therein, while operably with a bottle made of a hard material such as glass or polystyrene, does not stand up under continued use in softer material, such as polyethylene or polypropylene.

It is therefore an object of this invention to overcome the problems of the prior art.

Another object of the invention is to provide a cap which is more effective for polyethylene and polypropylene bottles and also enables the cap to be used with a bottle which is of the type that can accomodate either a safety cap or a cap of conventional construction.

Yet another object of the invention is to provide a safety cap which can be injection molded and which can stand up to the extreme wear and tear of constant opening and closing of the closure.

Still another object of the invention is to provide a new and improved cap which overcomes the problems which are created by a large torque force applied by an adult for opening the bottle which causes stripping of the threads of the bottle.

These and other objects of the invention are achieved by providing a new and improved safety cap of the screw-type for use in combination with a bottle having a threaded neck with a top planar edge. The cap includes a top wall and a depending peripheral skirt. The skirt has a thread on the inner surface thereof for rotatably engaging and securing the cap with the threaded neck of the bottle. The cap has a resilient member disposed under the top of the cap for engaging the top edge of the neck. The threads of the cap and the threads on the bottle are so dimensioned in thickness and space therebetween that the cap is axially slidable with respect to the bottle. The thread on the bottle has at least two interruptions which form at least two recesses on the thread of the bottle. The cap has at least two projections on the inner surface of the skirt. The projections are spaced both axially and radially with respect to each other, the same as the two recesses in the bottle thread. The projection on the skirt which is most spaced from the top of the cap is dimensioned so that it is too large to fit in any recess of the bottle other than the recess lowest on the neck of the bottle. The cap is secured to the bottle by rotating the cap until all of the projections are aligned with the recesses whereupon the resilient member causes the cap to be urged away from the bottle and the projections to be disposed in the recesses. The cap is thereby locked on the bottle and cannot be removed unless the user presses the cap against the bottle to dislodge the projections from the recesses to enable unscrewing of the cap.

Other objects and may of the attendant advantages of this invention will be readily appreciated as the same becomes better understood by reference to the following detailed description when considered in connection with the accompanying drawing wherein.

Figure 4:
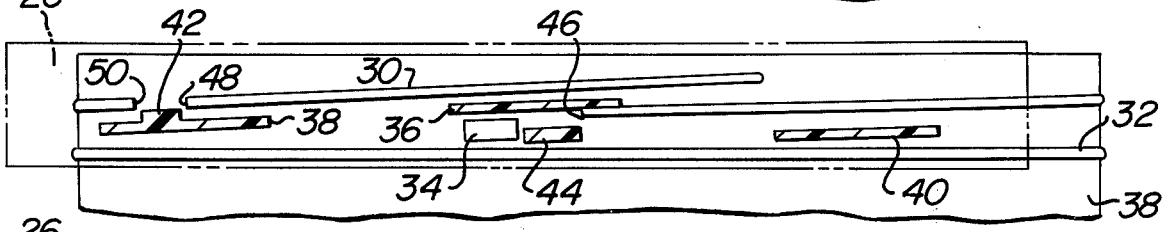
Figure 5:
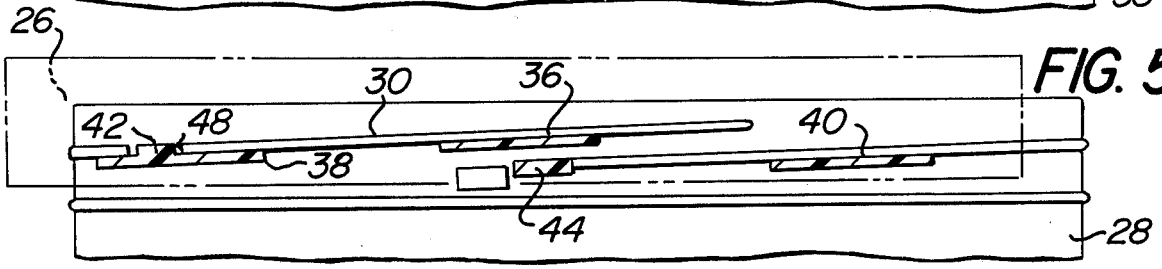

FIGS. 4 and 5 are schematic representations of the cap secured to the bottle with the skirt of the cap shown in an opened position in a planar configuration for purposes of clarity, and shown in phantom with the threads thereof shown in section and the bottle being opened in planar configuration and shown in elevation with the threads of the cap superimposed thereover. FIG. 4 shows the cap in its lowermost position with respect to the bottle and FIG. 5 shows the cap in an uppermost position with respect to the bottle with the cap rotated to its fully closed position with respect to the bottle.

Figure 1:
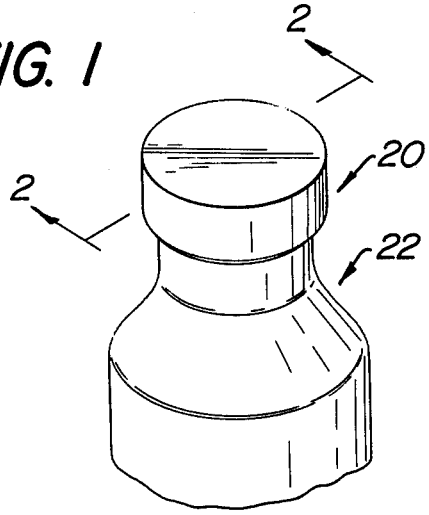
FIG. 1 is a perspective view of the cap embodying the invention secured to a bottle in a closed position.

Referring now in greater detail to the various figures of the drawing wherein like reference numerals refer to like parts, a safety cap embodying the invention is shown generally at 20 in FIG. 1.

Figure 2:
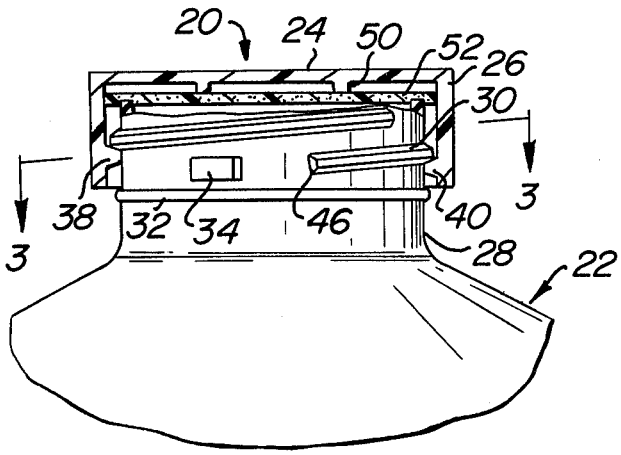
FIG. 2 is an enlarged sectional view of the cap taken along the line 2—2 with the bottle shown substantially in full and partly in section for purposes of clarity.
Figure 3:
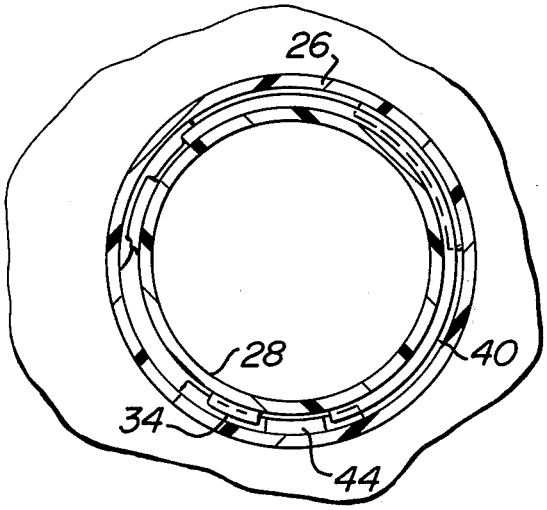
FIG. 3 is an enlarged sectional view taken along the line 3—3 in FIG. 2.

The safety cap 20 is shown secured to the neck of a bottle 22 in a closed position. As best seen in FIG. 2, the cap 20 includes a circular planar top wall 24 and a peripheral cylindrical skirt 26 which depends from the periphery of the top wall 24 and is integral therewith.

The bottle 22 includes a neck 28 which includes a screw thread 30 and an annular bead 32 which is disposed below the thread 30 entirely around the neck of the bottle. Adjacent the terminus of thread 30 and spaced therefrom there is provided on the bottle 22 a projection 34.

On the inner surface of skirt 26 of cap 20 is provided a thread which is comprised of three segments 36, 38 and 40. In addition, it includes a pair of projections 42 and 44 which are best seen in FIG. 5. Projection 42 is part of the segment of the thread 38 and projection 44 is spaced from and at substantially the same level as segment 40.

The bottom of thread 30 of the neck 28 of the bottle terminates at 46 and is spaced from projection 34 to form a recess for receipt of projection 44 when the cap 20 is fully rotated to the closed position of the cap with respect to the bottle neck 28. Rotation of the cap 20 is stopped by the abutment of projection 44 against projection 34. The thread 30 also includes another interrupted portion which starts at surface 48 and continues to surface 50, which surfaces form the edges of a recess for receipt of projection 42. As can best be seen in FIG. 4, projection 42 in integral with thread 38 and projects upwardly therefrom.

It should be understood that the FIGS. 4 and 5 are schematic views to illustrate the alignment of the threads on the cap and on the bottle neck and the alignment of the projections 42 and 44 with the recesses formed by the interruption of the thread 30. The skirt 26 of the cap is shown in an opened up form, that is with the skirt being disposed in a planar configuration and the neck 28 also being shown in a planar configuration for purposes of clarity. The neck of the bottle 28 is shown in full with the skirt 26 of the cap shown in phantom and the threads and projections being shown in section superimposed over the side elevational view of the neck in both FIGS. 4 and 5. There is disposed below the top wall 24 of the cap 20 an annular flange 50 which depends from the bottom surface of top wall 24 and is integral therewith. A resilient member comprised of a polyurethane foam insert 52 which is comprised of a planar circular disc is disposed adjacent the annular flange 50. The resilient member 52 rests on the top surface of the neck 28 which is preferably planar and which abuts the insert 52 when the cap 20 is rotated to the closed position with the projection 44 of the cap disposed adjacent to the projection 34 of the neck of the bottle.

The threads of the neck and the cap are so dimensioned that there can be axial movement of the cap with respect to the neck of the bottle. That is, as seen in FIG. 4, the skirt 26 of the cap is shown in its lowermost position with respect to the neck 28 of the bottle. In this position, the segment 36 of the thread rests on the portion of thread 30 which is at the end of the thread at surface 46 and also on the top of projection 34. Similarly, the thread 38 is disposed below the portion of thread 30 adjacent to the recess between surfaces 48 and 50 and the segment 40 is disposed adjacent the bead 32. When the skirt is in this position with respect to the bottle 28 as shown in FIG. 4, the top surface of the neck 28 abuts the resilient insert 52 thereby causing a bending of the insert about the flange 50 with the periphery of the insert closer to the top wall 24 than the center thereof.

When the projections 42 and 44 are in the position shown in FIG. 4 they are aligned with the recesses formed by the interruption in the thread 30 and thereby are movable upwardly into the recess.

When pressure is relieved from the cap, the resilient member 52 urges the cap upwardly and causes the skirt 26 to be disposed in the position shown in FIG. 5 with respect to the bottle neck 28.

It should be noted that the projection 44 is wider than the recess formed by the interruption in bead 30 between surfaces 48 and 50. This prevents the projection 44 from being inadvertently allowed to enter the recess formed between surfaces 48 and 50 when the cap is screwed onto the bottle 22. In addition, it should be noted that the projection 44 is disposed below segment 36 which is longer than the opening between the end surface 46 of bead 30 and the projection 34. The size of thread segment 36 prevents the bottommost portion of the thread 30 from being overridden or destroyed by the thread on the cap when the cap is rotated to an open position after it has been urged downwardly as shown in FIG. 4. That is, since the thread segment 36 cannot go into a position where the thread can abut surface 46 of the thread 30, the thread segments on the cap and bottle cannot entangle and thereby cause the potential for an override.

The provision of the additional recess in bead 30, in addition to that caused by the spacing between projection 34 and the end surface 46 of bead 30, causes there to be greater engagement between the cap and the bead to help protect against an adult applying a torque force to the cap 20 for removing the same from overriding the thread 30 of the bottle when the adult has forgotten to press the cap downwardly before opening the bottle. That is, with a polyethylene or polypropylene bottle, the thread 30 provided on the neck thereof has more resilience and give than does the surface of a thread on a polystyrene or glass bottle. For this reason, there must be more contact between the projections on the cap with the end surface of the recesses which prevents the rotation without the disengagement of the projections from the recesses. Accordingly, this is accomplished in the instant invention by providing the additional projection 42 which is radially spaced from the projection 44. By providing the extra protection and recess, there is a substantial buttressing of the cap against removal by an adult without pressing the cap against the bottle before removing the same. This prevents the thread on the bottle from being overriden and potentially mutilated and thereby prevents the cap from acting as a safety cap in the future.

Because the projection 44 is longer than the recess formed by the end surfaces 48 and 50 of the bead 30, when the cap is initially screwed on, the projection 44 cannot inadvertantly be aligned with and drawn within the recess formed thereby.

The length of the segments 36, 38 and 40 are also dimensioned so that they prevent the pressing down of the cap against the bottle from also locking the safety cap against removal by causing the thread to be in a position where it rides on the top surface of the thread of the bottle and thereby assures an easy, smooth removal of the cap from the bottle as it is rotated in a counter-clockwise direction.

Without further elaboration, the foregoing will so fully illustrate our invention that others may, by applying current or future knowledge, readily adapt the same for use under various conditions of service.

What is claimed as the invention is:

1. A screw-type safety cap for use in combination with a bottle having a threaded neck with a top planar edge, said cap including a top wall and a depending peripheral skirt, said skirt having a thread on the inner surface thereof for rotatably engaging and screwing said cap with the threaded neck of said bottle, said cap having a resilient member disposed under the top of said cap for engaging the top edge of said neck, said threads of said cap and the threads on said bottle being so dimensioned in thickness and space therebetween that the cap is axially slidable with respect to said bottle, said threads on said bottle having at least two interruptions which form at least two recesses in the threads of said bottle, said cap having at least two projections on the inner surface of said skirt, said projections being spaced both axially and radially with respect to each other, as are the two recesses in said bottle thread, the projection on said skirt which is most spaced from the top of said cap being dimensioned so that it is too large to fit in any recess of said bottle other than the recess lowest on the neck of said bottle, said cap being secured to said bottle by rotating said cap until all of said projections are aligned with said recess, said resilient member causing said cap to be urged away from said bottle and the projections to be disposed in said recesses whereby said cap in locked on said bottle and cannot be removed unless the user presses said cap against the bottle to dislodge said projections from said recesses to enable unscrewing said cap.

2. The safety cap of claim 1 wherein said thread of said cap is formed of a plurality of segments.

3. The safety cap of claim 1 wherein the lower of said projections on said cap is disposed below one of the segments of said thread, said segment being disposed over the thread of said neck so that said thread of said neck acts as a stop to axial movement when said cap is pressed toward said bottle and enables unscrewing said top.

4. The safety cap of claim 1 wherein said lowermost recess is formed by the terminus of said thread on said bottle, and a stop adjacent but spaced from said terminus to limit rotation of said cap to prevent loss of resilience between said cap and said bottle.

* * * * *